US007744248B2

(12) United States Patent
Kobinata et al.

(10) Patent No.: US 7,744,248 B2
(45) Date of Patent: Jun. 29, 2010

(54) LIGHTING FIXTURE

(75) Inventors: Katsumi Kobinata, Tokyo (JP); Katsuya Mochizuki, Tokyo (JP); Toshiyuki Kondo, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 168 days.

(21) Appl. No.: 12/169,627

(22) Filed: Jul. 8, 2008

(65) Prior Publication Data

US 2010/0008089 A1 Jan. 14, 2010

(51) Int. Cl.
*F21V 7/04* (2006.01)
*F21V 13/04* (2006.01)

(52) U.S. Cl. ..... 362/249.02; 362/249.06; 362/235; 362/311.02; 362/245

(58) Field of Classification Search ..... 362/216, 362/500, 249.02, 249.06, 311.02, 235, 245, 362/268, 27, 331, 30
See application file for complete search history.

(56) References Cited

U.S. PATENT DOCUMENTS 6,113,247 A * 9/2000 Adams et al. ..... 362/237
6,450,661 B1 * 9/2002 Okumura ..... 362/240
6,857,762 B2 * 2/2005 Shimokawa et al. ..... 362/245
7,178,923 B2 * 2/2007 Imade ..... 353/102
7,237,927 B2 * 7/2007 Coushaine et al. ..... 362/554
7,506,985 B2 * 3/2009 Radominski et al. ..... 353/94
2003/0156409 A1 * 8/2003 Choate et al. ..... 362/235

FOREIGN PATENT DOCUMENTS

JP 3099041 10/2003
JP 2005243256 9/2005
JP 2005327524 11/2005

* cited by examiner

*Primary Examiner*—Stephen F. Husar
*Assistant Examiner*—Peggy A. Neils
(74) *Attorney, Agent, or Firm*—Kenealy Vaidya LLP

(57) ABSTRACT

A compact lighting fixture having various functions can be achieved at low cost. The lighting fixture can provide a high degree of freedom for space utilization, can provide a comfortable illumination space with designed light distribution, can be configured to require a smaller space for installation, and can have an appearance that is not so different from its surroundings. As a component constituting the illumination optical system, a polygonal frustum portion can be located at a center and can have tapered side reflecting portions. When assuming that three concentric imaginary circles have respective radii of R1, R2 and R3 (R1<R2<R3) and a center positioned at a center axis of the frustum portion, individual lens portions can be located at respective intersections where the imaginary circle having the radius of R1 and lines extending radially from the center at regular center angles of α intersect. Light-incident lenses can be located at respective intersections where the imaginary circle having the radius of R2 and bisectors of the center angles of α intersect. LEDs can be located at respective intersections where the imaginary circle having the radius of R3 and lines connecting the center and positions of the light-incident lenses intersect.

19 Claims, 5 Drawing Sheets

LIGHTING FIXTURE

BACKGROUND

1. Technical Field

The presently disclosed subject matter relates to lighting fixtures, and in particular, to a lighting fixture to be used as a footlight, a night light, a space light, a convenience light, etc.

2. Related Art

The fields of application and purposes of various lighting fixtures are wide. One example of a lighting fixture is a footlight or a night light which are used for safety purposes or convenience. Various types of footlights or night lights have been proposed, which include one embedded in a wall of a room at a lower portion thereof for illuminating a floor surface (see, for example, Japanese Patent Application Laid-Open No. 2005-243256), one serving as a portable electric torch-like light mounted on a wall surface so as to be detachable (see, for example, Japanese Patent Application Laid-Open No. 2005-327524), one embedded in a piece of furniture for illuminating an area surrounding the furniture or serving as a footlight, and the like.

When a lighting fixture is attached on a wall, illumination light emitted therefrom is radiated from the wall surface. Accordingly, any obstacles such as furniture cannot be disposed in front of, or near, the wall. This limitation can reduce interior design efficiency as well as limit space utilization efficiency.

In case of the embedded lighting fixture, it is required to secure a space for accommodating the lighting fixture that is to be embedded as well as to provide a structure therefore. The embedding structure may provide a different appearance from its surroundings (design or aesthetic limitations) and also may increase the cost.

Conventional footlights or night lights are designed to provide a practically sufficient illumination effect, but any illumination effect for a space (for example, providing a comfortable environment, etc.) has not been taken into consideration.

SUMMARY

In view of the foregoing characteristics, features, and problems associated with conventional lighting fixtures, an aspect of the presently disclosed subject matter is to provide a compact lighting fixture having various functions at low cost. The thus designed lighting fixture can provide a high degree of freedom in utilizing an occupied space and a comfortable illumination space with a wide range of designed light distribution, and can be configured to occupy a smaller space for installation, and can have an appearance that is not so different from the lamp's surroundings.

In order to achieve the above, according to an aspect of the presently disclosed subject matter, a lighting fixture can include: a light transmitting portion; a reflecting portion facing towards the light transmitting portion and substantially in parallel therewith; a frustum portion having a top surface arranged adjacent the light transmitting portion side, a center axis being substantially perpendicular to a surface of the light transmitting portion and at least one continuous slanting reflection surface at its side surface; and a plurality of individual lens portions, a plurality of light-incident lenses and a plurality of LEDs, which are arranged inside an area defined by the light transmitting portion, the reflecting portion, and the frustum portion. In this lighting fixture, the individual lens portions, the light-incident lenses and the LEDs can be arranged in this order from the nearest position to a center of the frustum portion to a farther position.

In this instance, the frustum portion may be formed of a polygonal frustum or a frustum of a cone.

In the above-structured lighting fixture, when assuming that three concentric imaginary circles have respective radii of R1, R2 and R3 (R1<R2<R3) and a center positioned at a center axis of the frustum portion, the individual lens portions can be located at respective intersections where the imaginary circle having the radius of R1 and lines extending radially from the center at regular center angles of $\alpha$ intersect. Furthermore, the light-incident lenses can be located at respective intersections where the imaginary circle having the radius of R2 and bisectors of the center angles of $\alpha$ intersect, and the LEDs can be located at respective intersections where the imaginary circle having the radius of R3 and lines connecting the center and the positions of the light-incident lenses intersect.

In the above-structured lighting fixture, each of the LEDs can have an optical axis, and each of the light-incident lenses can have a center axis. The optical axis of the LED and the center axis of the corresponding light-incident lens can be located on a substantially same line and the slanting reflection surface can be located on the optical axis of the LED.

In the above-structured lighting fixture, the individual lens portions can each have a cylindrical, elliptic cylindrical or prismatic shape.

In the above-structured lighting fixture, any of the individual lens portions and the light-incident lens can be formed integrally with the light transmitting portion.

In the above-structured lighting fixture, the top surface of the frustum portion can be in contact with the light transmitting portion and end faces of the individual lens portions and the light-incident lenses can be in contact with the reflecting portion.

As discussed above, a lighting fixture made in accordance with the principles of the presently disclosed subject matter can have a light transmitting portion and a reflecting portion substantially in parallel with each other and a frustum portion having a top surface arranged adjacent or near the light transmitting portion and at least one continuous slanting reflection surface at its side surface. The individual lens portions, the light-incident lenses and the LEDs can be arranged, inside the area defined by the light transmitting portion, the reflecting portion, and the frustum portion, in this order from the nearest position to a center of the frustum portion.

The light emitted from the LEDs can be guided through the corresponding light-incident lenses and then reflected by the slanting reflection surface and/or the reflecting portion or reflected and/or refracted by the individual lens portions, thereby being radiated through the light transmitting portion to the outside.

As a result, a compact lighting fixture having various functions can be achieved at low cost. The thus designed lighting fixture can provide a high degree of freedom for space utilization, can provide a comfortable illumination space with designed light distribution, can require a smaller space for installation, and can have an appearance that is not so different from its surroundings.

BRIEF DESCRIPTION OF THE DRAWINGS

These and other characteristics, features, and advantages of the presently disclosed subject matter will become clear from the following description with reference to the accompanying drawings, wherein.

DETAILED DESCRIPTION OF EXEMPLARY EMBODIMENTS

Figure 1:
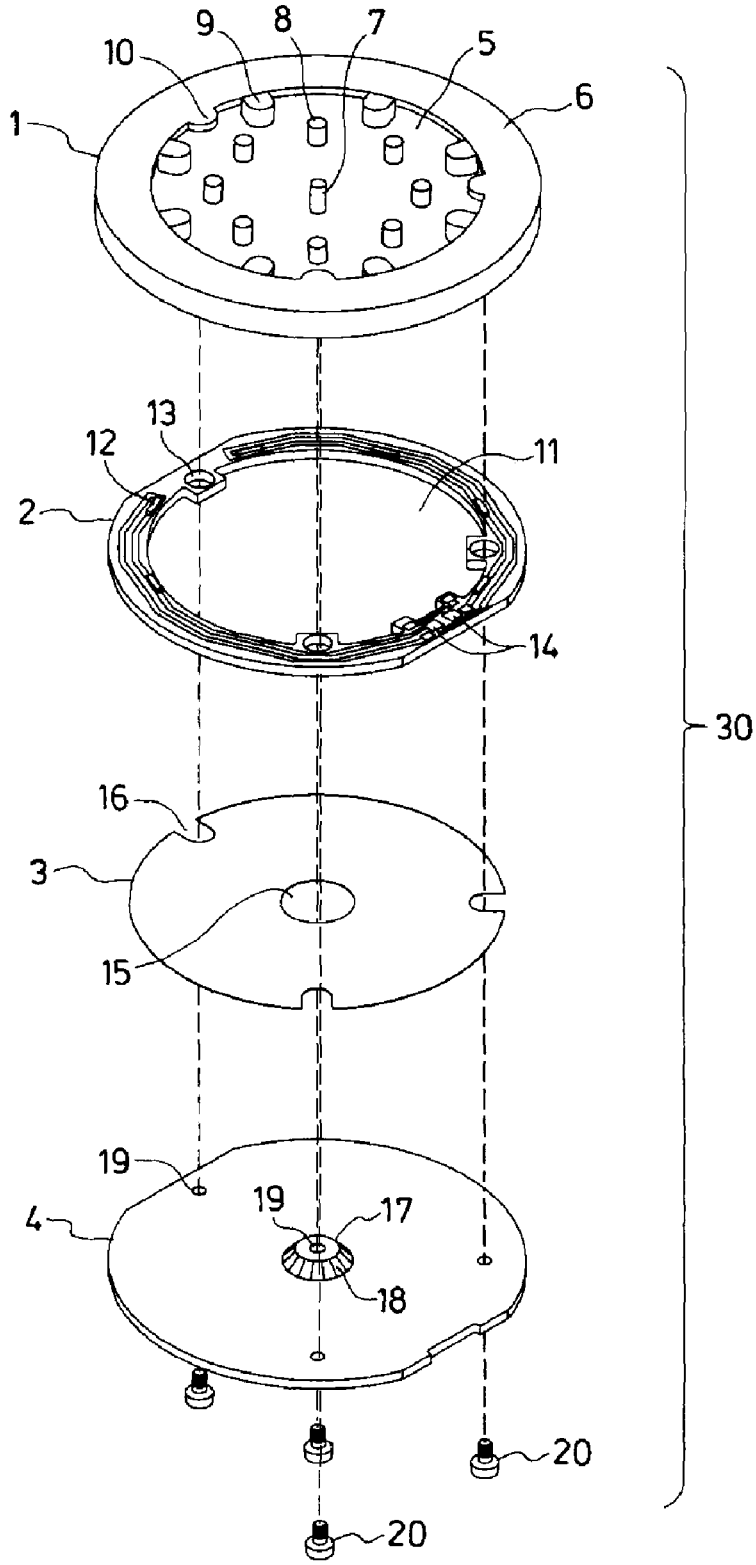
FIG. 1 is an exploded perspective view showing one exemplary embodiment of a lighting fixture made in accordance with the principles of the presently disclosed subject matter.
Figure 2A:
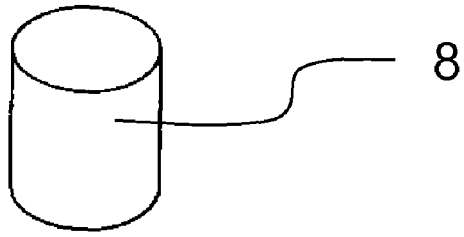
FIGS. 2A to 2E are perspective views showing several examples of an individual lens portion for use in the lighting fixture of FIG. 1.
Figure 2B:
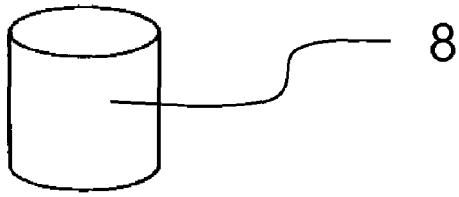
Figure 2C:
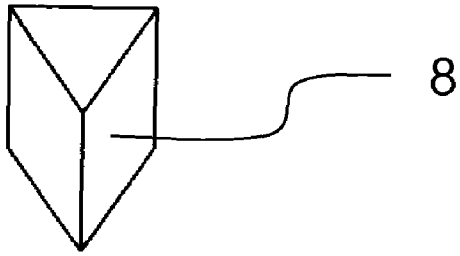
Figure 2D:
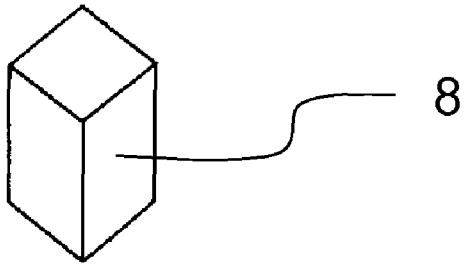
Figure 2E:
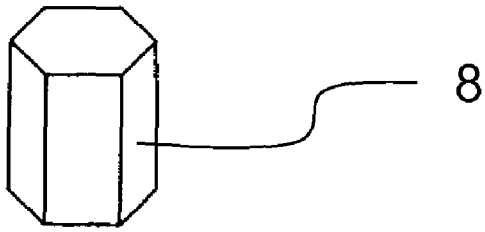

Hereinafter, a description will be given of an exemplary embodiment with reference to FIG. 1 through FIG. 7. In the shown exemplary embodiment, the same or similar parts are denoted by the same reference numerals/symbols.

FIG. 1 is an exploded perspective view showing one exemplary embodiment of a lighting fixture made in accordance with the principles of the presently disclosed subject matter. The lighting fixture 30 of the present exemplary embodiment can be mainly composed of a casing 1, a printed substrate 2, a reflecting plate 3, and a rear cover 4.

The casing 1 can be composed of a disk-shaped light transmitting portion 5 and a frame portion 6 located around the light transmitting portion 5. The frame portion 6 can have a cylindrical projection shape surrounding the light transmitting portion 5, which has an annular flat surface. The light transmitting portion 5 and the frame portion 6 can be formed integrally with each other by a two-color injection molding technique, for example.

The light transmitting portion 5 can be provided with a columnar first boss portion 7, a plurality of individual lens portions which can be configured, for example, as columnar lens portions 8, and a plurality of light-incident lenses which can be configured, for example, as columnar light-incident lenses 9. The first boss portion 7 can be located at the center of the light transmitting portion 5 and can have a screw hole for connection via screwing. The columnar lens portions 8 can be arranged on a first imaginary circle having a center at the center position of the disk-shaped light transmitting portion 5 at substantially regular center angles about the first imaginary circle. The light-incident lenses 9 can be arranged on a second imaginary circle, which is concentric with the first imaginary circle, and at substantially regular center angles about the second imaginary circle.

As shown in FIGS. 2A through 2E, the individual lens portions 8 can take any shape selected from the group consisting of a cylindrical shape, an elliptic cylindrical shape, and prismatic shapes including a triangular prism, a quadratic prism, a hexagonal prism, and the like. The light-incident lenses 9 each can have a curved face projected toward the center of the light transmitting portion 5, with the face taking a shape of part of cylinder or elliptic cylinder as an exemplary shape.

The frame portion 6 can be formed as a cylinder shape having at least one cut-out portion for housing a connector or the like, which will be described later. At the inner edge portion of the frame portion 6 which lies on a concentric circle having a center at the center position of the disk-shaped light transmitting portion 5, columnar second boss portions 10 can be formed at substantially regular center angles, with the boss portions 10 each having a screw hole for screwing. The second boss portions 10 have a larger-diameter base portion and a smaller-diameter tip portion with a step formed therebetween. It should be noted that the first boss portion 7, the individual lens portions 8 and the light-incident lenses 9 can be formed integrally with the disk-shaped light transmitting portion 5 which can be made of a light-transmitting resin material. Further, the second boss portions 10 can be formed integrally with the frame portion 6, which can be made of a light-shielding resin material. The number of individual lens portions 8 and the number of light-incident lenses 9 can be the same, for example, eight (8) in the present exemplary embodiment. The number of the second boss portions 10 is three (3) in the present exemplary embodiment.

The printed substrate 2 can have an annular shape having a hollowed-out portion 11 formed at its center. The hollowed-out portion 11 has a virtual center and a plurality of LEDs 12 can be arranged on a third imaginary circle, which has a center at the virtual center of the hollowed-out portion 11 and is substantially concentric with the first and second imaginary circles, and the LEDs 12 can be spaced at substantially regular center angles about the third imaginary circle. Each of the LEDs 12 can be directed with its optical axis being in parallel with the printed substrate 2 and directed toward the virtual center of the substrate 2.

Furthermore, a plurality of through holes 13 for screwing can be formed in the printed substrate 2 at positions which are located on an imaginary circle with its center at the virtual center of the substrate 2, and spaced at substantially regular center angles about the third imaginary circle. Electrode patterns 14 can be formed on part of the printed substrate 2 for connecting connector terminals. A white resist layer can be formed on the printed substrate 2 by, for example, silk-screen printing or the like, except the areas where the LED electrode pattern and the connector terminal electrode patterns 14 are formed. In the present exemplary embodiment, the number of the through holes 13 is three (3).

The reflecting plate 3 can have a disk shape and a fitting hole 15 at its center for receiving a frustum portion, to be described later. The fitting hole 15 has its virtual center at the center of the first through third imaginary and concentric circles, and the reflecting plate 3 can include a plurality of cut-out portions 16 formed about an imaginary circle, which has a center at the virtual center of the fitting hole 15, and which are spaced about the imaginary circle at substantially regular center angles. In the present exemplary embodiment, the number of the cut-out portions 16 is three (3).

The rear cover 4 can have a disk shape and a polygonal frustum portion 17 formed at its center position. Side surfaces of the polygonal frustum portion 17 can be formed to serve as tapered reflection portions 18. Furthermore, a plurality of screwing holes 19 can be formed in the rear cover 4, including a screw hole 19 located at a center of the polygonal frustum portion 17 and in the rear cover 4 about an imaginary circle and at substantially regular center angles about the imaginary circle. In the present exemplary embodiment, the number of the screwing holes 19 is four (4) in total.

Assembly of the above-described components can be achieved by the following procedures, for example: First, the printed substrate 2 on which the LEDs 12 have been mounted is housed in the casing 1 in such a manner that the LED mounting surface thereof faces towards the light transmitting portion 5 of the casing 1; then, the reflecting plate 3 is installed so as to be located on the surface of the printed substrate 2 opposite to the LED mounting surface thereof; The rear cover 4 is housed in the casing 1 from the rear side of the reflecting plate 3 in such a manner that the polygonal frustum portion 17 is fitted into the fitting hole 15 of the reflecting plate 3; screws 20 are inserted from the rear side of the rear cover 4 into the screwing holes 19 provided to the rear cover 4, through the cut-out portions 16 provided to the reflecting plate 3 (or the fitting hole 15), and through the through holes 13 provided in the printed substrate 2 (or the hollowed-out portion 11) correspondingly, and are finally screwed into the screw holes provided to the second boss portions 10 of the casing 1 (or the screw hole provided in the first boss portion 7). Then, all of the components are tightened together by the screwing action to complete the assembly.

Figure 3:
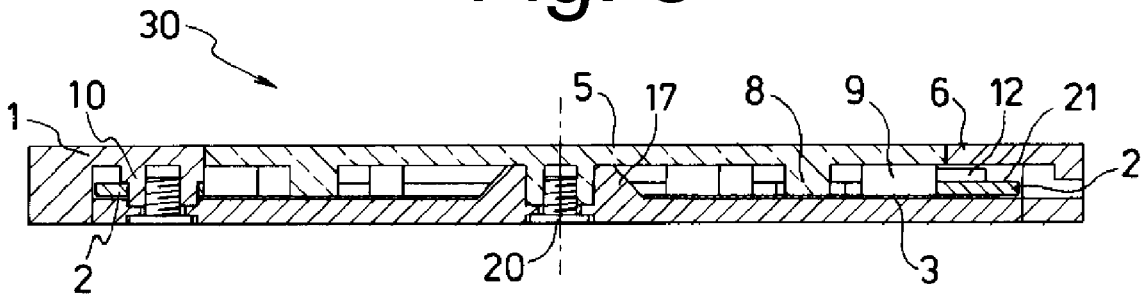
FIG. 3 is a cross-sectional view of the lighting fixture of FIG. 1.

FIG. 3 shows a cross-sectional view of an exemplary embodiment of a complete lighting fixture 30. As shown in this drawing, the printed substrate 2 can be in contact with the step of the second boss portion 10 at its edge portion, thereby securing a space between the LED mounting surface 21 of the printed substrate 2 and the frame portion 6. In this space, the LEDs 12 can be housed.

In this complete lighting fixture 30, the end surfaces of the light-incident lenses 9 and the individual lens portions 8 can be in contact with the reflecting plate 3. Furthermore, the upper surface of the polygonal frustum portion 17 can be in contact with the light transmitting portion 5. This can secure the space between the casing 1 and the rear cover 4. Furthermore, the space can be secured even when compressed stress may be applied from both sides of the lighting fixture (namely, both surfaces of the casing 1 and the rear cover 4).

In this instance, the upper surface of the frame portion 6 of the casing 1 can be at the same level as that of the light-transmitting portion 5. Furthermore, the end face (outer peripheral face) of the cylinder of the frame portion 6 can be at the same level as that of the rear cover 4.

Figure 4:
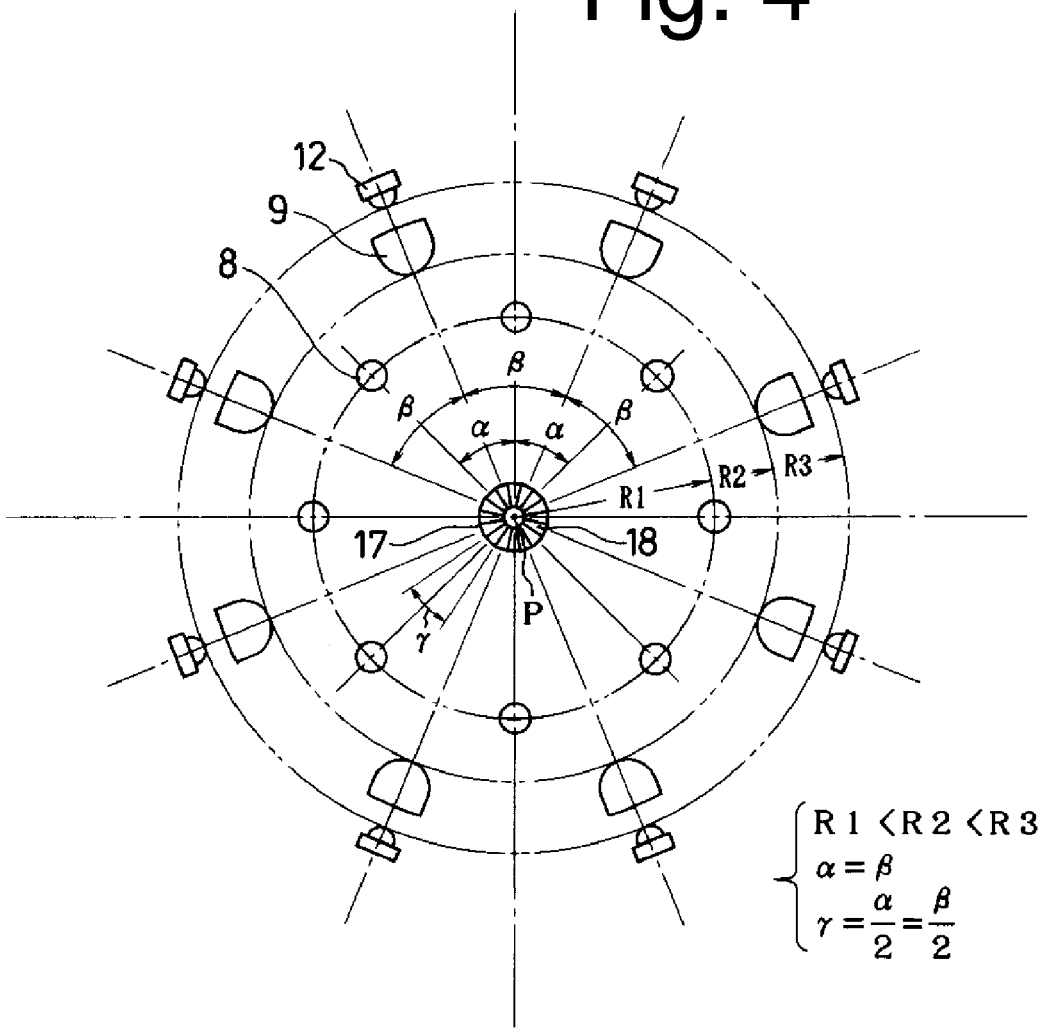
FIG. 4 is a partial plan view of the lighting fixture of FIG. 1.

A description will now be given of the optical system of the lighting fixture 30. FIG. 4 shows the physical relationship between the LEDs 12, the light incident lenses 9, the individual lens portions 8, and the tapered reflecting portions 18 when the lighting fixture 30 is viewed from the illumination direction thereof (from above the upper side of the light transmitting portion 5 of the casing 1 of FIG. 3).

Here, the center of the lighting fixture 30 is denoted by "P." Three imaginary concentric circles can be located about the same center P and can have respective radii of R1, R2 or R3, wherein the relationship of R1<R2<R3 holds.

The individual lens portions 8 can be located at respective intersections where the imaginary circle having the radius of R1 and lines extending radially from the center P at regular center angles of $\alpha$ intersect.

Furthermore, the light-incident lenses 9 can be located at respective intersections where the imaginary circle having the radius of R2 and bisectors of the center angles of $\alpha$ intersect, so that the apex of each of the lenses 9 is positioned at the intersection. Furthermore, the optical axis of the light incident lens 9 can be directed toward and can be configured to intersect with the center P.

The LEDs 12 can be located at respective intersections where the imaginary circle having the radius of R3 and lines connecting the center P and the apex positions of the light-incident lenses 9 intersect, so that the apex of each of the LEDs 12 is positioned at the respective intersections. Furthermore, the optical axis of the LED 12 can be directed toward and intersect the center P.

As described above, the numbers of the individual lens portions 8, the light incident lenses 9, and the LEDs 12 can be the same, which is eight (8) in the present exemplary embodiment.

Furthermore, the number of the side reflecting faces of the polygonal frustum portion 17 can be twice the number of the individual lens portions 8 (or the light incident lenses 9 or the LEDs 12). Accordingly, in the present exemplary embodiment the polygonal frustum portion 17 has a hexadecagonal frustum shape. In this case, each of the tapered reflecting portions 18 formed in the side faces of the polygonal frustum portion 17 has sides (continuous sides) such that lines formed by projecting the sides onto the light transmitting portion 5 can form an angle gamma which is equal to the half of the angle alpha (or the half of the angle beta). Namely, the line can serve as the bisector between the line connecting the center P and the individual lens portion 8 and the line connecting the center P and the adjacent light incident lens 9 (see FIG. 4).

Figure 5:
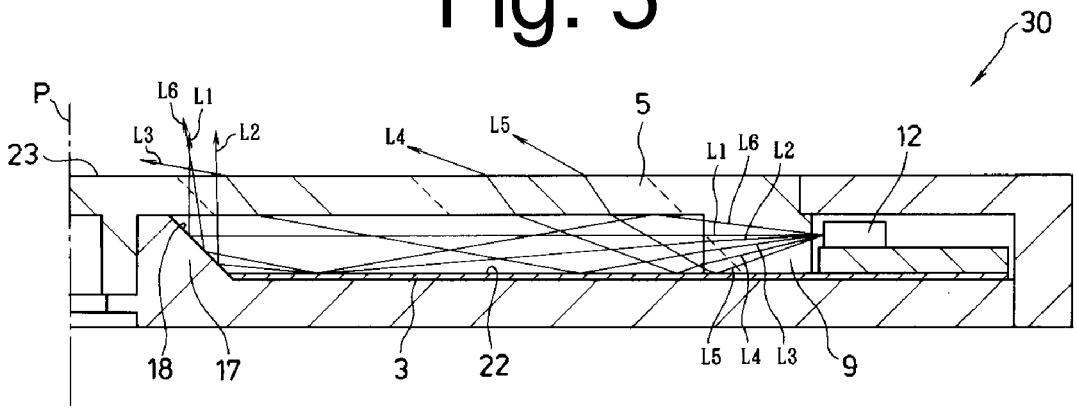
FIG. 5 is a partial longitudinal cross-sectional view schematically showing a light path of the lighting fixture of FIG. 1.
Figure 6:
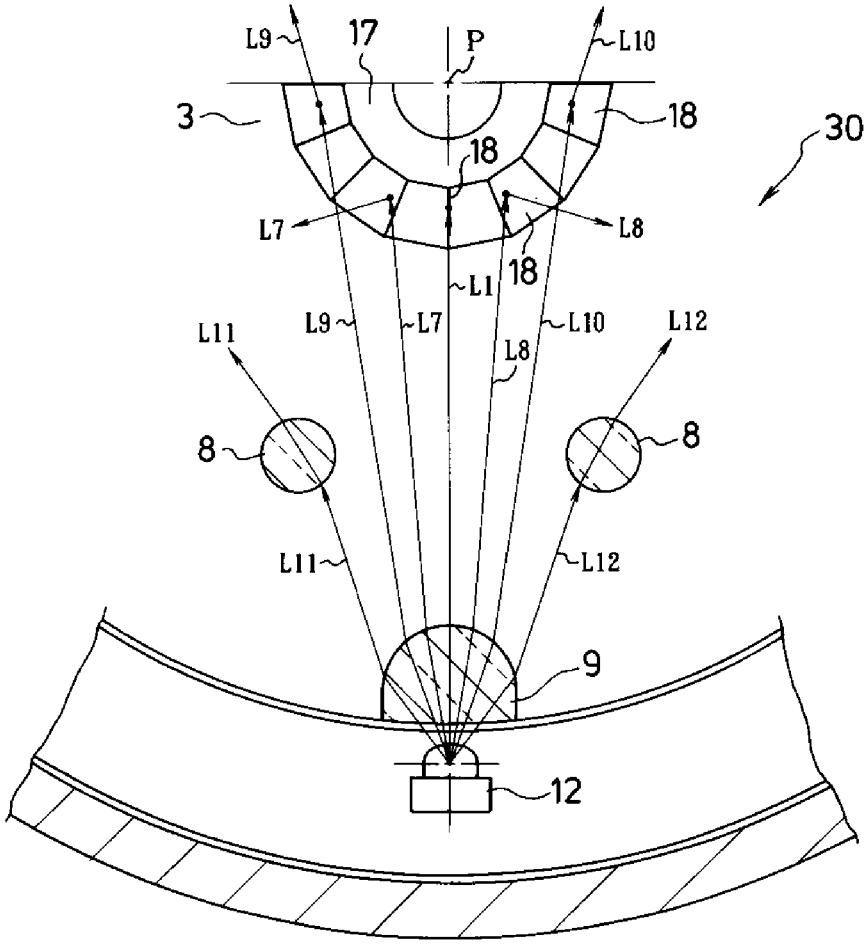
FIG. 6 is a partial horizontal cross-sectional view schematically showing a light path of the lighting fixture of FIG. 1.

FIGS. 5 and 6 are each a schematic view showing light paths for the lighting fixture and for the light emitted from the LEDs. FIG. 5 is a partial longitudinal cross-sectional view when cutting the lighting fixture 30 in a direction perpendicular to the reflecting plate 3. FIG. 6 is a partial horizontal cross-sectional view when cutting the lighting fixture 30 in a direction horizontal to (or parallel with) the reflecting plate 3.

In FIG. 5, light ray L1 is emitted from the LED 12 toward the center P of the polygonal frustum portion 17 and substantially in parallel with the reflecting plate 3. Then, the light ray L1 reaches the tapered reflecting portion 18 of the polygonal frustum portion 17 while being guided through the light incident lens 9. Furthermore, the light ray L1 reaches the light transmitting portion 5 after being reflected by the tapered reflecting portion 18, and is guided through the light transmitting portion 5 and radiated outward.

Light ray L2 through light ray L5 can also be emitted from the LED 12 toward the center P of the polygonal frustum portion 17 while slightly directed to the direction of the reflecting plate 3. The light ray L2 is emitted at a shallow angle with respect to the reflecting plate 3 and reaches the reflecting surface 22 of the reflecting plate 3 after being guided through the light incident lens 9, and reaches the tapered reflecting portion 18 after being reflected from the reflecting surface 22, and then reaches the light transmitting portion 5. Then, the light ray L2 is guided through the light transmitting portion 5 to the outside.

The light ray L3 through light ray L5 are emitted at a deeper or greater angle with respect to the reflecting plate 3 and each reaches the reflecting surface 22 of the reflecting plate 3 after being guided through the light incident lens 9, are then reflected by the reflecting surface 22 to reach the light transmitting portion 5, and finally guided through the light transmitting portion 5 to be radiated outward.

Furthermore, light ray L6 is emitted from the LED 12 toward the center P of the polygonal frustum portion 17 while being slightly directed toward the light transmitting plate 5. The light ray L6 is guided by the light incident lens 9 and reaches the light transmitting plate 5 and can be totally reflected by the light transmitting plate 5 toward the reflecting surface 22 of the reflecting plate 3. Then, the light ray L6 is reflected by the reflecting surface 22 to reach the tapered reflecting portion 18. After being reflected by the tapered reflecting portion 18, the light L6 reaches the light transmitting portion 5 to be guided therethrough to the outside.

As a result, of the light radiated from the light transmitting portion 5, the light that passes along the light path from the tapered reflecting portion 18 of the polygonal frustum portion 17 to the light transmitting portion 5 can be radiated at a deep angle with respect to the light emitting surface 23 of the light transmitting portion 5 (in a direction substantially perpendicular to the light emitting surface 23). The light that passes along the light path from the reflecting surface 22 of the reflecting plate 3 to the light transmitting portion 5 can be radiated at a relatively more shallow angle with respect to the light emitting surface 23 of the light transmitting portion 5 (in a direction substantially horizontal to or parallel with the light emitting surface 23).

As a result, the lighting fixture 30 can emit light from the light transmitting portion 5 in upward and sideward directions, thereby enabling illumination of an extremely wide area.

On the other hand, as shown in FIG. 6, the light ray L1 emitted from the LED 12 toward the center P of the polygonal frustum portion 17 in parallel with the reflecting plate 3 can be guided by the light incident lens 9 to reach the tapered reflecting portion 18 of the polygonal frustum portion 17. Accordingly, the reflected light ray L1 can be radiated through the light transmitting portion 5 to the outside.

Furthermore, light ray L7 through light ray L10 can be emitted from the LEDs 12 toward a position near the polygonal frustum portion 17 and in parallel with the reflecting plate 3. The light rays L7 through L10 can reach the tapered reflecting portion 18 of the polygonal frustum portion 17 after being guided through the light incident lens 9, then reaching the light transmitting portion 5 by reflection of the tapered reflecting portion 18.

Light ray L11 and light ray L12 can also be emitted from the LED 12 toward positions that do not intersect with (or are outside of) the polygonal frustum portion 17 and travel substantially in parallel with the reflecting plate 3. The light rays L11 and L12 can reach the individual lens portions 8 correspondingly after being guided through the light incident lens 9, and can then be guided through the individual lens portions 8, to be emitted outward (i.e., at least one of the three dimensional direction vectors of each light ray having a component in the light emitting direction of the lighting fixture).

As a result, as in the case shown in FIG. 5, the lighting fixture 30 of FIG. 6 can emit light upward and sideward from the light transmitting portion.

In particular, since the plurality of individual lens portions 8 are formed at respective predetermined positions within the area of the light transmitting portion 5, they can reflect or refract light from the LEDs which are arranged in various directions, towards various directions. Accordingly, each of the individual lens portions can form a light distribution from the position of the individual lens portion as an origin. Accordingly, the designed individual lens portions can direct light toward predetermined directions for simply contributing to the illumination function of the lighting fixture while they can also direct light toward specific directions for achieving a certain special illumination effect (for example, providing a comfortable environment, etc.), thereby controlling the required light distribution properties.

In the present exemplary embodiment, the frustum portion 17 takes a polygonal frustum shape, although the presently disclosed subject matter is not limited thereto. For example, the frustum portion 17 can take a frustum of a cone or the like having a continuously curved tapered side reflecting portion 18. This configuration can achieve substantially the same effect as that of the present exemplary embodiment.

As described above, the end surfaces of the light-incident lenses 9 and the individual lens portions 8 can be in contact with the reflecting plate 3. Furthermore, the upper surface of the polygonal frustum portion 17 can be in contact with the light transmitting portion 5. This can secure the space between the casing 1 and the rear cover 4. Furthermore, even when compressed stress may be applied from both sides of the lighting fixture (namely, both surfaces of the casing 1 and the rear cover 4), the space can be secured.

Figure 7:
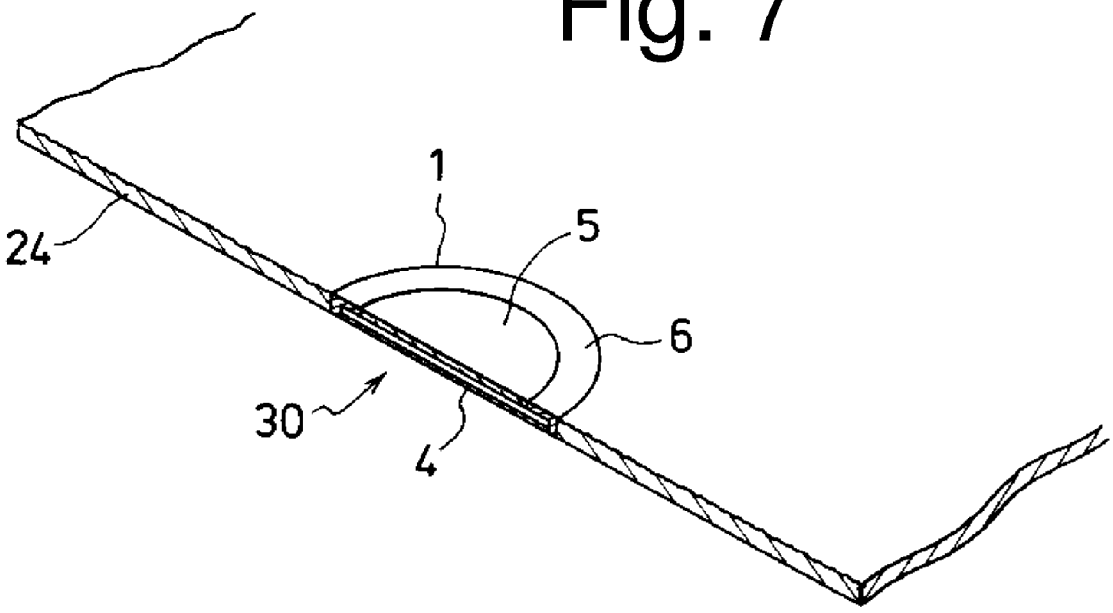
FIG. 7 is a partial cross-sectioned perspective view showing a carpet where the lighting fixture of FIG. 1 is installed.

As shown in FIG. 7, the lighting fixture 30 in accordance with the presently disclosed subject matter can be embedded in a carpet 24 or rug having a thickness of approximately 5 mm for installation. In this instance, the lighting fixture 30 does not protrude from the carpet 24. Furthermore, the rigid structure formed by the lens portions 8 and the lenses 9 as well as the center frustum portion 17 can constitute a lighting fixture 30 that is strong enough for one to step upon it.

In order to secure high weight loads, the heights of the individual lens portions 8, the light incident lenses 9, and the polygonal frustum portion 17 should be 10 mm or lower. If the height is higher than 10 mm, the entire thickness of the lighting fixture is inevitably higher, resulting in possible deterioration of the maximum weight load.

It will be apparent to those skilled in the art that various modifications and variations can be made in the present invention without departing from the spirit or scope of the invention. Thus, it is intended that the present disclosure cover the modifications and variations of this invention provided they come within the scope of the appended claims and their equivalents. All related and conventional art references described above are hereby incorporated in their entirety by reference.

What is claimed is:

1. A lighting fixture comprising:

a light transmitting portion;

a reflecting portion facing towards the light transmitting portion and substantially in parallel with the light transmitting portion;

a frustum portion having a top surface arranged adjacent the light transmitting portion, a center axis being perpendicular to a surface of the light transmitting portion, and at least one continuous slanting reflection surface forming a side surface of the frustrum portion; and a plurality of individual lens portions, a plurality of light-incident lenses and a plurality of LEDs, which are arranged inside an area defined by the light transmitting portion, the reflecting portion, and the frustum portion, wherein the individual lens portions are located closest to the center axis of the frustum portion, the light-incident lenses are located further from the center axis of the frustum portion relative to the individual lens portions, and the LEDs are located furthest from the center axis of the frustum portion relative to the individual lens portions and the light incident lenses.

2. The lighting fixture according to claim 1, wherein the frustum portion is formed of any of a polygonal frustum or a frustum of a cone.

3. The lighting fixture according to claim 1, wherein, when assuming that first, second and third concentric imaginary circles have respective radii of R1, R2 and R3 (R1<R2<R3) which each have a center positioned at the center axis of the frustum portion, the individual lens portions are located at respective intersections where the first imaginary circle having the radius of R1 and linear lines extending radially from the center at regular center angles of $\alpha$ intersect, the light-incident lenses are located at respective intersections where the second imaginary circle having the radius of R2 and linear bisectors of the center angles of $\alpha$ intersect, and the LEDs are located at respective intersections where the third imaginary circle having the radius of R3 and linear lines connecting the center and the positions of the light-incident lenses intersect.

4. The lighting fixture according to claim 2, wherein, when assuming that first, second and third concentric imaginary circles have respective radii of R1, R2 and R3 (R1<R2<R3) which each have a center positioned at the center axis of the frustum portion, the individual lens portions are located at respective intersections where the first imaginary circle having the radius of R1 and linear lines extending radially from the center at regular center angles of $\alpha$ intersect, the light-incident lenses are located at respective intersections where the second imaginary circle having the radius of R2 and linear bisectors of the center angles of α intersect, and the LEDs are located at respective intersections where the third imaginary circle having the radius of R3 and linear lines connecting the center and the positions of the light-incident lenses intersect.

5. The lighting fixture according to claim 1, wherein each of the LEDs has an optical axis, and each of the light-incident lenses has a center axis, and wherein the optical axis of at least one of the LEDs and the center axis of a corresponding one of the light-incident lenses are located on a substantially same linear line and the slanting reflection surface is located on the optical axis of the at least one of the LEDs.

6. The lighting fixture according to claim 2, wherein each of the LEDs has an optical axis, and each of the light-incident lenses has a center axis, and wherein the optical axis of at least one of the LEDs and the center axis of a corresponding one of the light-incident lenses are located on a substantially same linear line and the slanting reflection surface is located on the optical axis of the at least one of the LEDs.

7. The lighting fixture according to claim 3, wherein each of the LEDs has an optical axis, and each of the light-incident lenses has a center axis, and wherein the optical axis of at least one of the LEDs and the center axis of a corresponding one of the light-incident lenses are located on a substantially same linear line and the slanting reflection surface is located on the optical axis of the at least one of the LEDs.

8. The lighting fixture according to claim 4, wherein each of the LEDs has an optical axis, and each of the light-incident lenses has a center axis, and wherein the optical axis of at least one of the LEDs and the center axis of a corresponding one of the light-incident lenses are located on a substantially same linear line and the slanting reflection surface is located on the optical axis of the at least one of the LEDs.

9. The lighting fixture according to claim 1, wherein each of the individual lens portions has at least one of a cylindrical, an elliptic cylindrical, and a prismatic shape.

10. The lighting fixture according to claim 1, wherein at least any one of the individual lens portions and the light-incident lenses is formed integrally with the light transmitting portion.

11. The lighting fixture according to claim 10, wherein the top surface of the frustum portion is in contact with the light transmitting portion and end faces of the individual lens portions and the light-incident lenses are in contact with the reflecting portion.

12. A lighting fixture having a light emitting direction along an optical axis of the lighting fixture, comprising:

a light transmitting portion having an emission surface facing in the light emitting direction of the lighting fixture, the light transmitting portion including an outermost peripheral edge located about the optical axis of the lighting fixture;

a reflecting portion facing towards the light transmitting portion and substantially in parallel with the light transmitting portion;

a frustum portion having a center axis extending in the light emitting direction of the lighting fixture and substantially perpendicular to the emission surface of the light transmitting portion, the frustrum portion having at least one angled reflection surface forming a side surface of the frustrum portion at an acute angle with respect to the center axis;

a plurality of lens portions located within the outer-most peripheral edge of the light transmitting portion when viewed from the light emitting direction and along the optical axis of the lighting fixture;

a plurality of light-incident lenses located within the outermost peripheral edge of the light transmitting portion when viewed from the light emitting direction and along the optical axis of the lighting fixture; and a plurality of LEDs located adjacent the light transmitting portion, wherein the individual lens portions are located closest to the center axis of the frustum portion, the light-incident lenses are located further from the center axis of the frustum portion relative to the individual lens portions, and the LEDs are located furthest from the center axis of the frustum portion relative to the individual lens portions and the light incident lenses.

13. The lighting fixture according to claim 12, wherein the frustum portion is at least one of a polygonal frustum and a frustum of a cone.

14. The lighting fixture according to claim 12, wherein, when assuming that first, second and third concentric imaginary circles have respective radii of R1, R2 and R3 (R1<R2<R3) which each have a center positioned at the center axis of the frustum portion, the individual lens portions are located at respective intersections where the first imaginary circle having the radius of R1 and linear lines extending radially from the center at regular center angles of α intersect, the light-incident lenses are located at respective intersections where the second imaginary circle having the radius of R2 and linear bisectors of the center angles of α intersect, and the LEDs are located at respective intersections where the third imaginary circle having the radius of R3 and linear lines connecting the center and the positions of the light-incident lenses intersect.

15. The lighting fixture according to claim 12, wherein each of the LEDs has an optical axis, and each of the light-incident lenses has a center axis, and wherein the optical axis of at least one of the LEDs and the center axis of a corresponding one of the light-incident lenses are located on a substantially same linear line and the slanting reflection surface is located on the optical axis of the at least one of the LEDs.

16. The lighting fixture according to claim 12, wherein each of the individual lens portions has at least one of a cylindrical, an elliptic cylindrical, and a prismatic shape.

17. The lighting fixture according to claim 12, wherein at least one of the individual lens portions and the light-incident lenses is formed integrally with and of the same continuous material as the light transmitting portion.

18. The lighting fixture according to claim 17, wherein the top surface of the frustum portion is in contact with the light transmitting portion, and end faces of the individual lens portions and the light-incident lenses are in contact with the reflecting portion.

19. The lighting fixture according to claim 12, wherein the frustrum portion and at least one of the light-incident lenses and a corresponding one of the LEDs and at least a corresponding one of the individual lens portions are located such that an imaginary linear line intersects each of the frustrum portion the at least one of the light-incident lenses and the corresponding one of the LEDs while the imaginary linear line is also completely spaced from and not intersecting with the corresponding one of the individual lens portions.

* * * * *